United States Patent [19]

Pace

[11] 4,022,420

[45] May 10, 1977

[54] FORMWORK AND CONNECTING MEANS APPARATUS FOR CASTING REINFORCED CONCRETE

[76] Inventor: Anacleto Pace, 10, via Cadorna, 60100 Ancona, Italy

[22] Filed: Nov. 6, 1975

[21] Appl. No.: 629,542

[52] U.S. Cl. ..... 249/194; 249/189; 249/192; 249/219 R; 249/219 W

[51] Int. Cl.[2] ..... E04G 9/06; E04G 17/04

[58] Field of Search ..... 249/44, 45, 47–49, 249/189, 192, 194, 196, 219 R, 219 W; 52/584, 758 C, 758 H

[56] References Cited

UNITED STATES PATENTS

| | | | |
|---|---|---|---|
| 906,493 | 12/1908 | Guthrie | 249/194 |
| 1,538,496 | 5/1925 | Wells | 249/194 |
| 2,808,624 | 10/1957 | Sullivan | 52/584 |
| 3,066,962 | 12/1962 | Koehler | 249/48 |
| 3,244,395 | 4/1966 | Arrighini | 249/194 |

FOREIGN PATENTS OR APPLICATIONS

| | | | |
|---|---|---|---|
| 1,052,664 | 3/1959 | Germany | 249/219 W |
| 725,135 | 3/1955 | United Kingdom | 249/219 R |
| 874,172 | 8/1961 | United Kingdom | 249/192 |

*Primary Examiner*—Richard B. Lazarus
*Assistant Examiner*—John McQuade

[57] ABSTRACT

Formwork apparatus for casting concrete comprising a plurality of flattened tubular elongated elements each having one wall with an outer surface for contacting cast concrete and an opposite wall with a series of aligned apertures therein. The elongated elements are assembled in juxtaposed relation to constitute the form work by means of retainers which are disengageably interfittable with adjacent elongated elements. Each retainer includes two projecting flanges which penetrate into the interior of apertures of adjacent elongated elements and the flanges are provided with notches for engaging the walls of the elements at the ends of the apertures so as to lock the elements in place.

7 Claims, 16 Drawing Figures

FIG. 1
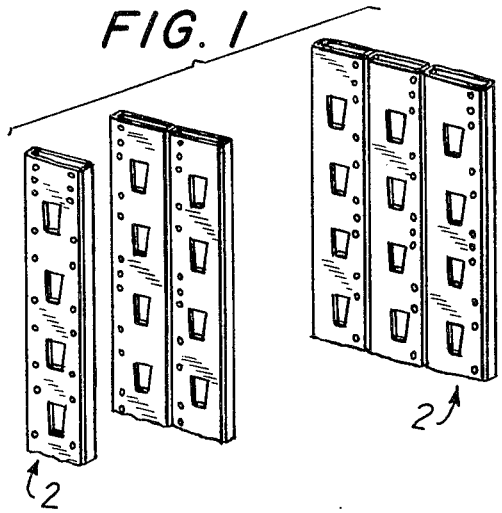
FIG. 2
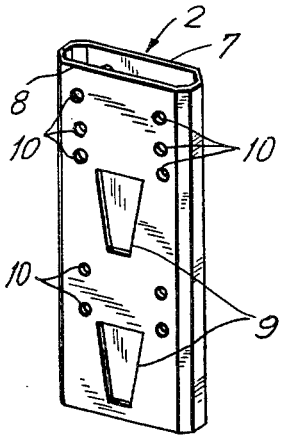
FIG. 5
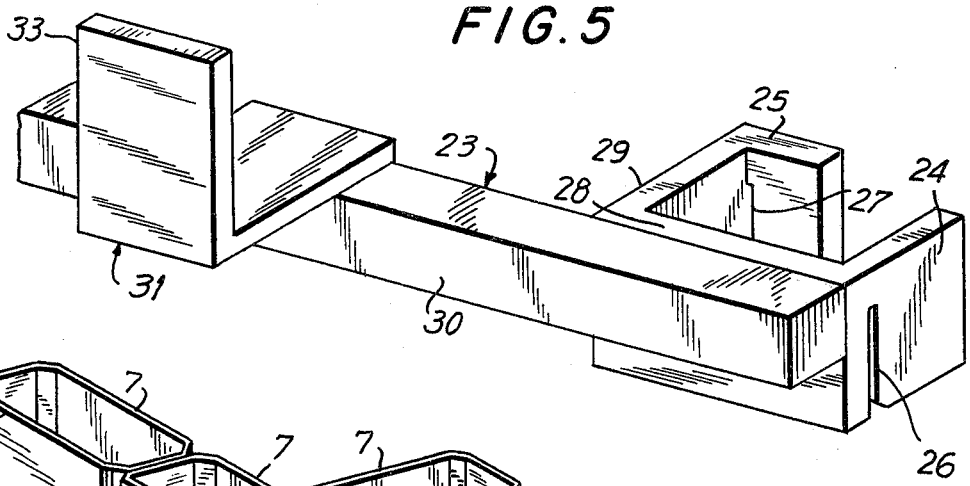
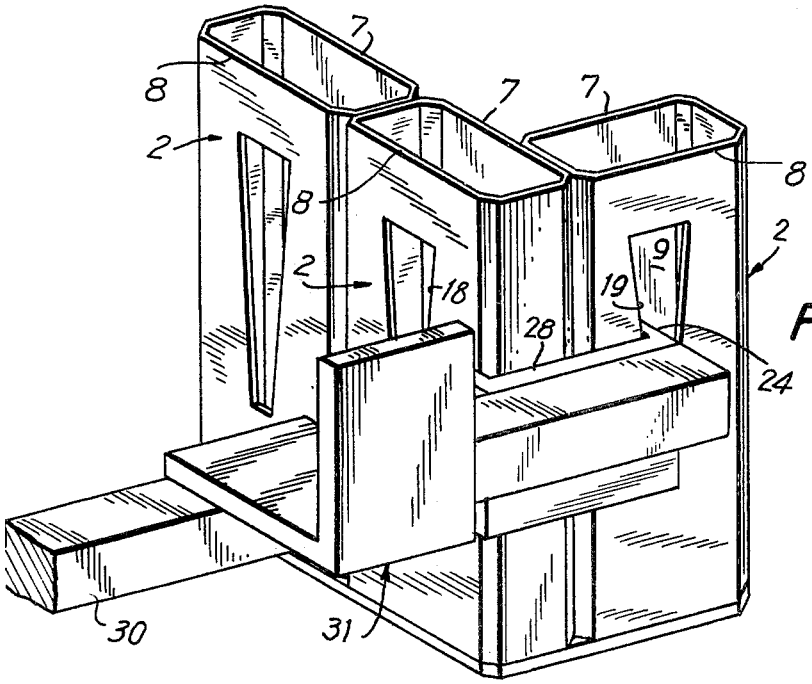
FIG. 6

FORMWORK AND CONNECTING MEANS APPARATUS FOR CASTING REINFORCED CONCRETE

FIELD OF THE INVENTION

The invention relates to formwork apparatus for the casting of concrete and particularly to such formwork apparatus which is readily disassemblable and reusable after a concrete pouring operation.

BACKGROUND AND SUMMARY OF THE INVENTION

Conventional formwork structure is well known in the art of casting concrete and in general such formwork is composed of shutters made of wood or plastic which are assembled in various ways to constitute the desired form. After the concrete has been cast the form is disassembled for subsequent use.

Conventionally, various types of fasteners are employed to secure the shutters to one another and in the disassembly it is necessary to remove the fasteners. This involves considerable time and effort and frequently the forms become broken as a result of the removal of the fasteners.

An object of the invention is to provide a formwork which is readily disassemblable and which does not rely upon the use of fasteners to assemble juxtaposed elements of the form.

It is a further object of the invention to provide formwork of the above type in which assembly between juxtaposed elements is simply made through the provision of a slidable locking engagement therewith.

In accordance with the invention, there is provided formwork for casting concrete comprising a plurality of flattened tubular elongated elements each having one wall with an outer surface for contacting cast concrete and an opposite wall with aperture means thereon, and retainer means disengagably interfittable with at least two of said elongated elements to hold the same in assembled juxtaposed relation, said retainer means including projection means for penetrating into the interior of each elongated element through the aperture means thereof while engaging that wall of such elongated element which is provided with the aperture means.

In further accordance with the invention the aperture means in each said tubular elongated element is constituted by a series of longitudinal aligned apertures of trapezoidal shape.

The invention further contemplates that said retainer means includes two flanges with notches therein, said flanges being engageable in said apertures of the elongated elements with said notches receiving the walls bounding the apertures.

In order to connect two elongated elements which are at right angles to one another, the flanges extend at right angles on the retainer means. When two elongated elements are to be connected which extend parallel to one another a retainer means is employed in which the flanges extend parallel to one another.

The invention further comtemplates the use of a manually engageable extension arm on the retainer and a stirrup in the form of an angle member can be secured to the extension arm for supporting and positioning planking on said arm.

According to a feature of the invention the retainer can be provided with pins for receiving tie down means which holds the formwork assembly in place and resists the bouyancy effect of the cast concrete.

According to a further feature of the invention, the apertures in the tubular elements are of trapezoidal shape and the flanges are dimensioned relative to the trapezoidal apertures to be insertable thereinto and moveable downwardly so that the notches in the flanges receive the walls of the elements at the lower ends of the apertures producing a force on the elements urging them against one another in a secured juxtaposed relation.

BRIEF DESCRIPTION OF THE DRAWING

FIG. 1 is a perspective view showing a plurality of juxtaposed formwork elements.

FIG. 2 is a view on enlarged scale of a portion of one element.

FIG. 5 is a perspective view showing a modified embodiment of a retainer element.

FIG. 6 shows the retainer element of FIG. 5 in operative engagement in a formwork assembly.

DETAILED DESCRIPTION

Figure 3:
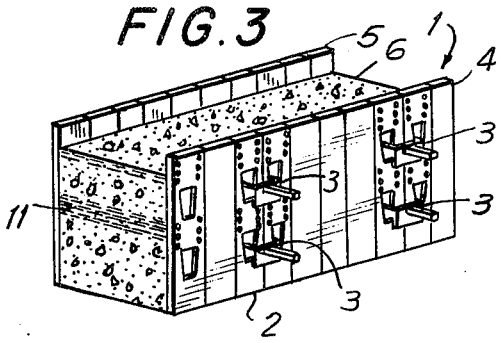
FIG. 3 is a perspective view showing an assembled formwork.

Referring to FIG. 3, herein is seen a formwork assembly 1 constituted generally by a plurality of juxtaposed elongated elements 2 secured in assembled fashion by means of connecting retainer elements 3. The retainer elements are intended to detachably secure the elongated elements 2 in the juxtaposed assembly so that after concrete has been cast in the assembled form the disassembly will be rapidly effected by disconnecting the retainer members 3.

In the assembly shown in FIG. 3 it is seen that the juxtaposed elements form opposite walls 4, 5 of the formwork and the concrete 6 is cast between these walls. As will be shown hereafter the geometric assembly of the elongated elements can be modified to accomodate substantially all shapes encountered in practice by means of various modifications in the configuration of the retainer elements.

It is seen in FIG. 3 that the assembled form 1 is constituted by two different types of elongated elements one being plain without apertures and the othere having apertures for the attachment of the retainer members 3. The plain elongated elements 2 without the apertures are secured to adjacent elements by any suitable means in order to provide an assembled wall.

Referring to FIG. 2 which shows the elements 2 having the apertures herein it is seen that each element 2 is of flattened tubular elongated shape and has a hollow interior. The element has an inner wall 7 adapted for coming into contact with the cast concrete and an opposite wall 8 in which there are formed apertures 9 of trapezoidal shape. These apertures 9 are aligned with one another in the longitudinal direction of the elongated element 2. Additionally, there are two rows of apertures 10 on opposite sides of the apertures 9 and apertures 10 extend through both walls 7 and 8 in aligned fashion. As seen in FIG. 3 the apertures 10 serve for the connection of turn-buckles 11 which join elongated elements of one wall with those of the opposite wall. It is to be noted in FIG. 3 that only the elongated elements at the left end of the form are connected by the turnbuckles and the remainder of the elements are interconnected by means of the retainers. Quite clearly the construction is adapted for any suitable interconnection as desired and as circumstances dictate. Moreover, as illustrated in FIG. 1, the line of holes 10 need not extend on both sides of the apertures 9 but could be provided either on the left or right side thereof.

In assembling the wall as shown in FIG. 3 it will generally be necessary to employ two retainers 3 for each pair of adjacent elongated apertured elements in the manner as shown, however, for casting concrete of great height such as in columns or the like, it may become necessary to provide for retainers at each of the apertures near the bottom of the column and the spacing of the retainers can be increased towards the top of the column. These are considerations which will be readily evident to those skilled in the art and which will be evident in use of the form elements of the invention.

Figure 4:
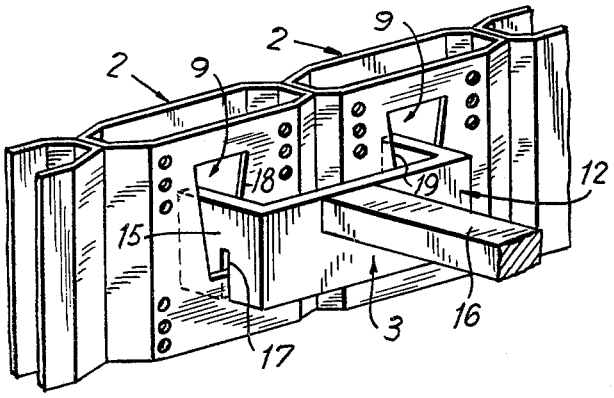
FIG. 4 is a perspective view on enlarged scale showing a portion of the formwork of FIG. 3.

Turning to FIG. 4 herein is shown the engagement of retainer 3 with two juxtaposed elongated elements 2. The retainer 3 comprises a U-shaped element 12 having parallel flanges 14 and 15 with a projecting extension arm 16 extending from the U-shaped element 12. Each flange 14, 15 is provided with a respective notch 17 extending partway through the height of the respective flange. In order to join two juxtaposed elements together the flanges 14 and 15 are inserted into the apertures 9 of adjoining elements 2 and the flanges are lowered towards the narrow ends of the apertures while the wall of the element passes into notches 16. The spacing between the flanges is such that when the retainer is moved downwardly in the apertures 9 the top of the notches will engage the pairs of side walls 18, 19 so as to force the elements 2 laterally against one another and to lock the elements 2 in this position. A gripping or vice-like engagement is obtained by this wedging-type action. Thereby the elements are locked together by the retainer 3. The arm 16 is manually engageable and facilitates the downward movement of the retainer so as to lock the adjacent elements.

The above arrangement is suitable for connecting adjacent parallel elements of a flat wall of the form.

When it is necessary to connect two elements 2 which are at right angles as shown in FIG. 6 the retainer of the shape as shown in FIG. 5 is employed. Herein the retainer designated by 23 includes flanges 24 and 25 which extend at right angles to one another. These flanges are provided with respective notches 26 and 27 which engage the walls of the elongated elements 2 in a manner similar to that explained hereinbefore and as readily evident from FIG. 6.

More specifically, referring to FIG. 5 it is seen that the retainer comprises the U-shaped assembly of base 28 and flanges 24 and 29, the flange 25 projecting from the end of flange 29 perpendicular thereto and thereby perpendicular to flange 24. The notch 26 is provided in flange 24 in the same fashion as in the embodiment of the retainer in FIG. 4, however, the notch 27 is formed at the apex or intersection of flanges 25 and 29. Thereby in assembling two elements at right angles to one another in the manner as shown in FIG. 6 the flange 24 is inserted into the aperture of one element and the flange 25 into the aperture of the other element. The notches 26 and 27 engage the side walls 18, 19 of the apertures to provide a tight locking engagement between the juxtaposed elements as in the previous embodiment of FIG. 4. The retainer 23 includes projecting arm 30 which is manually engageable as explained in connection with the previous embodiment to facilitate the handling of the retainer and particularly the engagement of the notches with the side walls of the apertures when the retainer is lowered in the apertures.

Figure 8:
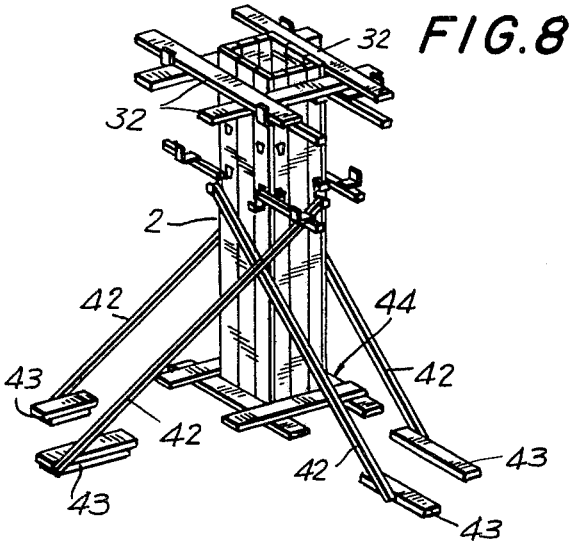
FIG. 8 shows an assembly of form members employing the retainer of FIG. 7.
Figure 10:
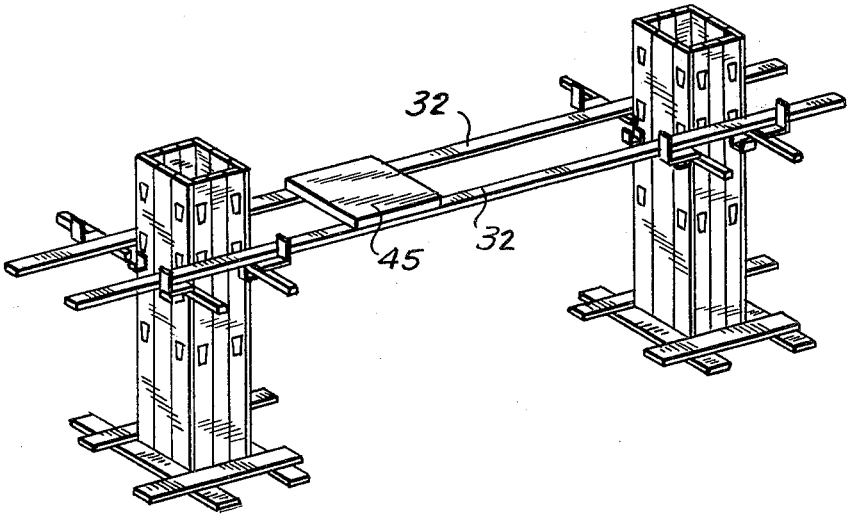
FIG. 10 shows another assembly of form elements for a concrete casting operation.

A stirrup 31 in the form of an angle member is secured on arm 30 in order to support lines of planking 32 as shown in FIG. 8. Such lines of planking can serve for connecting the forms of two columns as shown in FIG. 10 or for suspending weights to resist the upward bouyant force applied to the formwork by the poured concrete. The planking 32 can also be used as walkways for workmen.

As evident from FIG. 8 the position of the stirrups 31 is such that the planking 32 will abut against the upstanding flange 33 of the stirrup while abutting the outside faces of the elements 2. The stirrups are provided on the retainers for the corner elements which are at right angles to one another so that two lines of planking will overlap one another as shown in FIG. 8.

In FIG. 8 since only three elements 2 are used on each side of the form for the column it is only necessary to utilize retainers at the corners as shown. Obviously, however, in the case where a much greater number of elongated elements will be used to form the side walls it will be necessary to employ connections of the type as shown in FIGS. 3 and 4 as well as the ones shown in FIG. 8.

Figure 7:
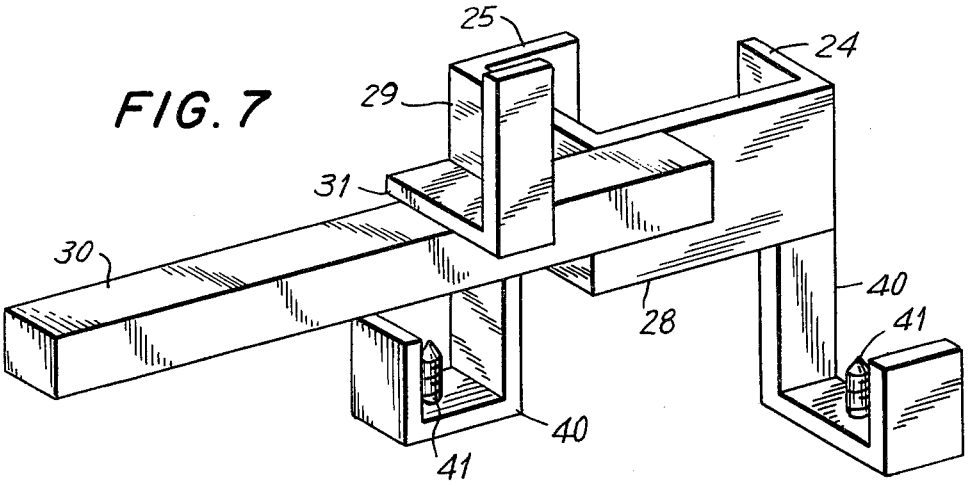
FIG. 7 shows a further modified embodiment of the retainer member.

FIG. 8 shows the additional use of retainers of the type as illustrated in FIG. 7 which in addition to the construction as shown in FIG. 5 employs depending Ushaped brackets 40 which are turned at right angles to one another. Each of the brackets 40 supports a respective pin 41 at the base of the bracket.

The brackets 40 and pins 41 are employed for attachment of a tie-down means in the form of tie-down elements 42 which are secured to base plank 43. By reason of this arrangement the bouyant effect on the formwork will be resisted by the tie-down means. As particularly shown, the tie-down elements are provided with holes which engage pins 41 at one end and the opposite end of the tie-down elements 42 are connected by pins at the other end to the planking 43 which is secured to the ground. The retainer elements of FIG. 7 are therefore used at the lower end of the column formwork while the elements of FIG. 6 are employed at higher elevations.

Figure 9:
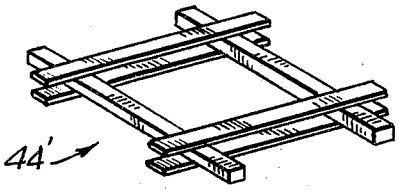
FIG. 9 shows a support at the base of the formwork of FIG. 8.

At the base of the column formwork in FIG. 8 there is a base planking 44 whose construction is shown in greater detail at 44' in a modification in FIG. 9 wherein cross planks are secured to one another in overlapping relation to retain the bottom edges of the elongated elements 2.

FIG. 10 shows the interconnection of two column formworks by means of planking 32 and plates 45 are supported on the planking 32 optionally along the entire length thereof so as to serve as connecting walkways between adjacent planks 32. The tie-down means in FIG. 10 has been omitted for purposes of simplifying the figure.

Figure 11:
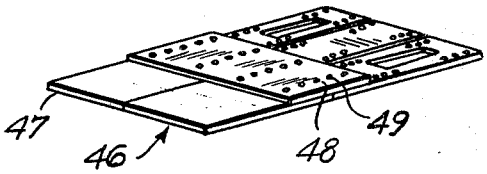
FIG. 11 shows the use of the elongated members for producing a sheathing.

Referring to FIG. 11 herein is seen the interconnection of adjacent elongated elements 2 so as to form a sheathing 46. The interconnection is effected by means of wooden planks 47 which are placed on the elongated members in adjoining relation and connection is made of the planks 47 by means of a cross plank 48. The connection of the planks 47 and 48 is made with the elongated elements 2 by means of fasteners 49 which pass through the planks and engage in the holes 10 of the elongated elements. Such sheathing has generalized use in formwork for concrete casting, for example, at the base of a column form.

Figure 12:
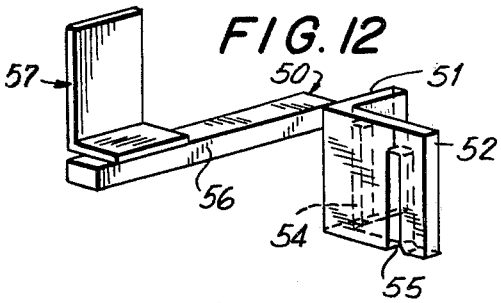
FIG. 12 shows a further modified embodiment of the retainer.
Figure 14:
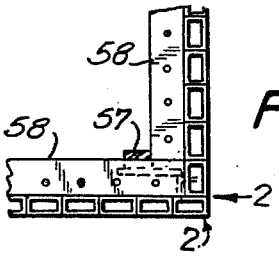
FIG. 14 is a top plan view showing the retainer of FIG. 12 in a formwork assembly.

FIG. 12 shows a modified retaining element 50 for use in the interior of two perpendicularly arranged walls of elements 2 as shown in FIG. 14. In the retainer 50 flanges 51 and 52 intersect at right angles and from an angle member, the flanges being provided with respective notches 54 and 55 for engaging in apertures 9 of respective elements 2. The projecting arm 56 extends from the flanges as in the previous embodiments and stirrup 57 is secured on arm 56.

As seen in FIG. 14 the flanges 51 and 52 engage elements 2 at the interior right angle thereof to assemble the same and the planks 58 overlap one another and are supported respectively on stirrups 57 and arm 56.

Figure 13:
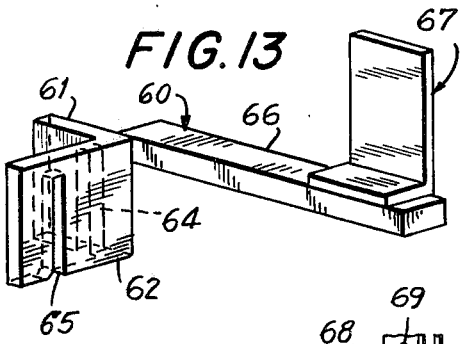
FIG. 13 shows yet another modified version of the retainer.
Figure 15:
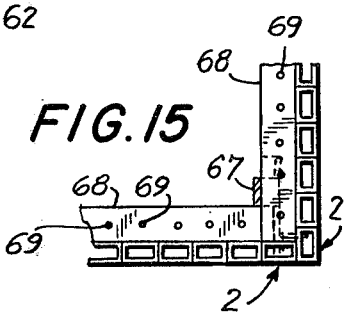
FIG. 15 is a plan view showing the retainer in FIG. 13 in a formwork assembly.

FIG. 13 shows a retainer 60 similar to that shown in FIG. 12 but the mirror image thereof. The retainer 60 has flanges 61 and 62 at right angles to one another with respective notches 64 and 65. The arm 66 extends from the flanges and carries the stirrup 67 thereon. FIG. 15 shows the interconnection of elements 2 using the retainer 60 of FIG. 13. Planks 68 are supported on the arm and retainer at right angles to one another as shown. The planks 68 can be tubular and hollow and formed with a line of holes 69 thereon so that at the locations where the planks overlap one another in the arrangement as shown in FIG. 16 the planks can be connected together by passage of a suitable wire fastener or the like through the holes of the adjacent planks.

Figure 16:
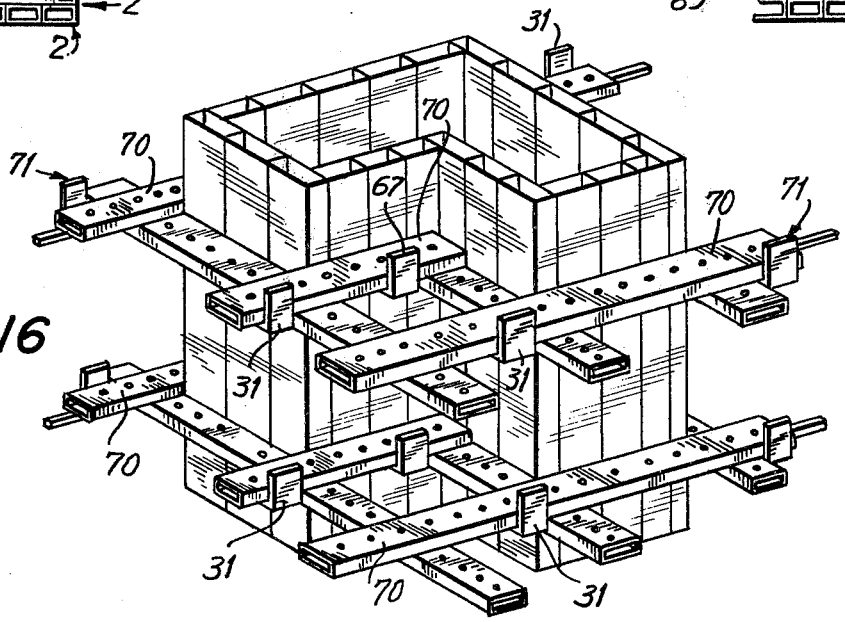
FIG. 16 is a perspective view showing another arrangement of formwork.

In FIG. 16 wherein a column member of L shape is being cast, the formwork employs elongated elements 2 arranged to form the L shape for the concrete, planks 70 and retainer elements at the corners. At the inside corner where the branches of the L intersect, the retainers are in the form as shown in FIG. 13. At the corner of the L there will be employed the retainers as shown in FIG. 5 and retainers 71 of mirror image thereto.

Although the invention has been described in relation with specific embodiments thereof it will become evident to those skilled in the art that the formwork can be employed in diverse fashion for casting complex shapes of concrete articles. Central to the invention is the detachable nature of the connection of the elongated elements 2 by the retainers and particularly the locking of the elements in assembled juxtaposed relation by engagement in the notches of the flanges of the retainer of the inclined side walls of the trapezoidal shaped aperture.

I claim:

1. Formwork for casting concrete comprising a plurality of flattened tubular elongated elements each having one wall with an outer surface for contacting cast concrete and an opposite wall with aperture means therein, and retainer means disengagably interfitted with at least two of said elongated elements holding the same in assembled juxtaposed relation, said aperture means in each said tubular elongated element being constituted by a series of longitudinal aligned apertures of trapezoidal shape, said retainer means including two flanges with notches therein, said flanges being secured together and engaged in the adjacent apertures of two juxtaposed elongated elements with said notches receiving the walls bounding the apertures.

2. Formwork apparatus as claimed in claim 1 wherein said flanges extend at right angles to one another for joining two tubular elements which are at right angles.

3. Formwork apparatus as claimed in claim 1 wherein said flanges extend parallel to one another to join two juxtaposed tubular elements which are parallel to one another.

4. Formwork apparatus as claimed in claim 1 comprising a manually engageable extension arm projecting from said flanges.

5. Formwork apparatus as claimed in claim 4 comprising an angle member secured on said extension arm for supporting and positioning planking thereon.

6. Formwork apparatus as claimed in claim 5 comprising pins mounted on said retainer means for receiving tie down means.

7. Formwork apparatus as claimed in claim 1 wherein said flanges are dimensioned relative to said trapezoidal apertures to be insertable into said apertures and be movable towards the narrow ends of said apertures to cause the walls at said narrow ends to pass in said notches the juxtaposed elongated elements being forced against one another as the flanges are moved towards said narrow ends.

* * * * *